US007404550B2

(12) United States Patent
Vogel et al.

(10) Patent No.: US 7,404,550 B2
(45) Date of Patent: Jul. 29, 2008

(54) METHOD FOR STITCHING PRINT PRODUCTS AND STITCHING MACHINE FOR REALIZING SAID METHOD

(75) Inventors: Stephan Vogel, Zofingen (CH); Roland Kost, Oftringen (CH)

(73) Assignee: Mueller Martini Holding AG, Hergiswil (CH)

( * ) Notice: Subject to any disclaimer, the term of this patent is extended or adjusted under 35 U.S.C. 154(b) by 232 days.

(21) Appl. No.: 11/206,040

(22) Filed: Aug. 18, 2005

(65) Prior Publication Data

US 2006/0043663 A1 Mar. 2, 2006

(30) Foreign Application Priority Data

Aug. 24, 2004 (EP) ..... 04405529

(51) Int. Cl.
*B65H 37/04* (2006.01)

(52) U.S. Cl. ..... 270/52.18; 270/52.16; 270/52.26; 270/52.29; 270/52.3; 270/58.07; 270/58.08

(58) Field of Classification Search ..... 270/52.16, 270/52.18, 52.26, 52.29, 52.3, 58.07, 58.08; 227/44, 81, 82, 88, 89, 100, 111, 99, 110
See application file for complete search history.

(56) References Cited

U.S. PATENT DOCUMENTS

| | | | | |
|---|---|---|---|---|
| 1,349,662 A | | 8/1920 | Christensen | |
| 2,827,632 A | * | 3/1958 | Faeber | 227/81 |
| 4,196,835 A | * | 4/1980 | Schlough | 227/81 |
| 4,614,290 A | * | 9/1986 | Boss | 227/1 |
| 4,641,825 A | * | 2/1987 | Mowry et al. | 270/52.26 |
| 6,142,353 A | * | 11/2000 | Boss et al. | 227/44 |
| 6,142,354 A | * | 11/2000 | Boss et al. | 227/100 |
| 6,164,511 A | * | 12/2000 | Chung et al. | 227/148 |
| 6,974,066 B2 | * | 12/2005 | Abe | 227/111 |
| 2002/0014510 A1 | * | 2/2002 | Richter et al. | 227/110 |

FOREIGN PATENT DOCUMENTS

| | | |
|---|---|---|
| DE | 43 06 744 A | 9/1993 |
| DE | 199 52 746 A | 5/2000 |
| EP | 0 958 942 A | 11/1999 |
| EP | 1 153 764 A | 11/2001 |

* cited by examiner

*Primary Examiner*—Gene O. Crawford
*Assistant Examiner*—Leslie A Nicholson, III
(74) *Attorney, Agent, or Firm*—Venable LLP; Robert Kinberg

(57) ABSTRACT

A wire stitching machine and a method for wire-stitching print products with the wire-stitching machine. At least one stitching head is arranged to move along with a respective print product to be stitched during a stitching operation. A control device is arranged to control the stitching head so that the stitching head is displaced relative to the print product following placement of a first staple by the stitching head in a print product to drive in at least one second staple at a distance to the first staple.

25 Claims, 5 Drawing Sheets

METHOD FOR STITCHING PRINT PRODUCTS AND STITCHING MACHINE FOR REALIZING SAID METHOD

CROSS-REFERENCE TO RELATED APPLICATION

This application claims the priority of European Patent Application No. 04405529.1, filed on Aug. 24, 2004, the subject matter of which is incorporated herein by reference.

BACKGROUND OF THE INVENTION

The invention relates to a method for stitching print products with a wire-stitching machine that comprises at least one stitching head and moves during the stitching operation along with a print product which is conveyed in a gathering and wire-stitching apparatus.

The wire-stitching of print products with the aid of staples in a gathering and wire-stitching apparatus has long been known and involves, for example, the stitching together of booklets consisting of several gathered, folded sheets in a wire-stitching machine. The products are generally transported by a gathering chain, provided with uniformly spaced carriers, in which the aforementioned folded sheets are gathered. The gathering chain conveys the gathered, folded sheets to the wire-stitching machine where the print products are wire stitched while in a stationary position or during the transport.

A method and machine of the aforementioned type for wire-stitching print products are known, for example, from European Application EP 0 958 942 A, which is co-owned by the assignee of the present application. This machine is provided with two stitching heads that are operated by a crank mechanism. The two stitching heads are positioned on a stitching-head carriage which moves along with the product to be stitched. If a product is to be stitched with three wire staples, then three stitching heads are needed and for the stitching with four wire staples, four stitching heads are needed.

A different type of stitching machine is further known from European Application EP 1 153 764 A.

SUMMARY OF THE INVENTION

It is an object of the present application to provide an alternative wire stitching machine and method of operation that reduce the high cost of equipment.

The above and other objects are accomplish according to the invention by the provision of a method for wire-stitching print products with a wire-stitching machine, comprising: conveying a print product on a gathering and wire-stitching apparatus; moving a stitching head along with the print product; driving a first wire staple in the print product with the stitching head; and following the driving of the first wire staple, displacing the stitching head relative to the print product and driving a second wire staple into the print product.

Accordingly, with the method according to the invention, at least two wire staples are placed into the same print product using the same stitching head. With this method, for example, booklets can be stitched multiple times using a single stitching head. For this, the stitching head is not moved along synchronously with the print product, as is the case at present, but is displaced along the print product following the placement of a first wire staple, such that at least one second wire staple can be placed. A stitching operation using considerably fewer components is thus possible and the respective wire-stitching machine can be produced at a lower cost.

A different and considerable advantage is furthermore seen in the fact that the spacing between wire staples can be adapted easier for a changeover to a different product.

It is also possible to attach three or more wire staples with a single stitching head to the same print product, thus resulting in considerable cost savings for the production and operation. In addition, it is much easier to adapt to a different type of stitching operation, for example using different wire staple positions and a different number of staples.

The stitching head according to one exemplary embodiment of the invention is provided with a driver and a forming means. The driver and/or the forming means are operated by a controlled motor, resulting in a direct drive for the driver and the forming means and, consequently, in a much simpler design. Unsteady and remote movements and expensive components can thus be avoided. It is furthermore possible to have a less massive machine frame for damping the vibrations.

According to a different exemplary embodiment of the invention, the at least one stitching head is arranged on a stitching-head carriage, driven by a controlled motor, wherein the drive is preferably a direct and linear drive. According to a further exemplary embodiment of the invention, a spindle is used for the drive. The spindle permits a particularly advantageous control and, in particular, an even easier adaptation of the wire-staple spacing during the changeover to a different print product. A manual changeover is no longer required and, in principle, such an adaptation can also take place without stopping the machine.

The linear drive with controlled motors in particular permits a further reduction in the number of moving components. As a result, fewer components exist between torque generation and torque consumption and only insignificant changes and/or distortions occur in the movement resulting from mass inertia, elasticity, and play. According to a another exemplary embodiment of the invention, it is possible to achieve a particularly high degree of freedom from play and high rigidity by using pre-tensioned ball screws and pre-tensioned axial bearings.

To optimize the staple quality, the driver speed for driving in a wire staple may be advantageously controlled independent of the cycle time for a stitching operation.

It has proven advantageous if the driver speed for this operation is constant.

The invention furthermore relates a wire-stitching machine for a gathering and wire-stitching apparatus, comprising: at least one stitching head arranged to move along with a respective print product to be stitched during a stitching operation; and a control device to control the stitching head so that the stitching head is displaced relative to the print product following a placement of a first staple to drive in at least one second staple at a distance to the first staple.

The stitching head may be advantageously provided with a separately operated driver and forming means, wherein controlled motors preferably may be used for the operation.

According to one exemplary embodiment of the invention, the stitching head may be advantageously positioned on a carriage driven by a controlled motor, thus resulting in a particularly simple design. The movements thus can be realized with considerably lower mass and the machine frame can additionally be less massive because fewer vibrations must be dampened. In particular, this results in more direct movements and more precise sequences. With less interference, a higher quality and in particular a higher stitching quality at the print product can be ensured.

It is also possible to perform more than two stitching operations with a single stitching head, wherein the staples can be driven in with constant or changeable speed.

The following are critical advantages of the wire-stitching machine according to the invention:

i. the number of moving parts can be reduced considerably;

ii. one, two, three or more wire staples can be placed with a single stitching head;

iii. changing the spacing between staples, the positions of the staples, and the number of staples is considerably easier; and iv. the production costs and the operating costs can be lowered.

BRIEF DESCRIPTION OF THE DRAWINGS

These and other features and advantages of the invention will be further understood from the following detailed description of the preferred embodiments with reference to the accompanying drawings, in which.

DETAILED DESCRIPTION OF THE PREFERRED EMBODIMENTS

Figure 1:
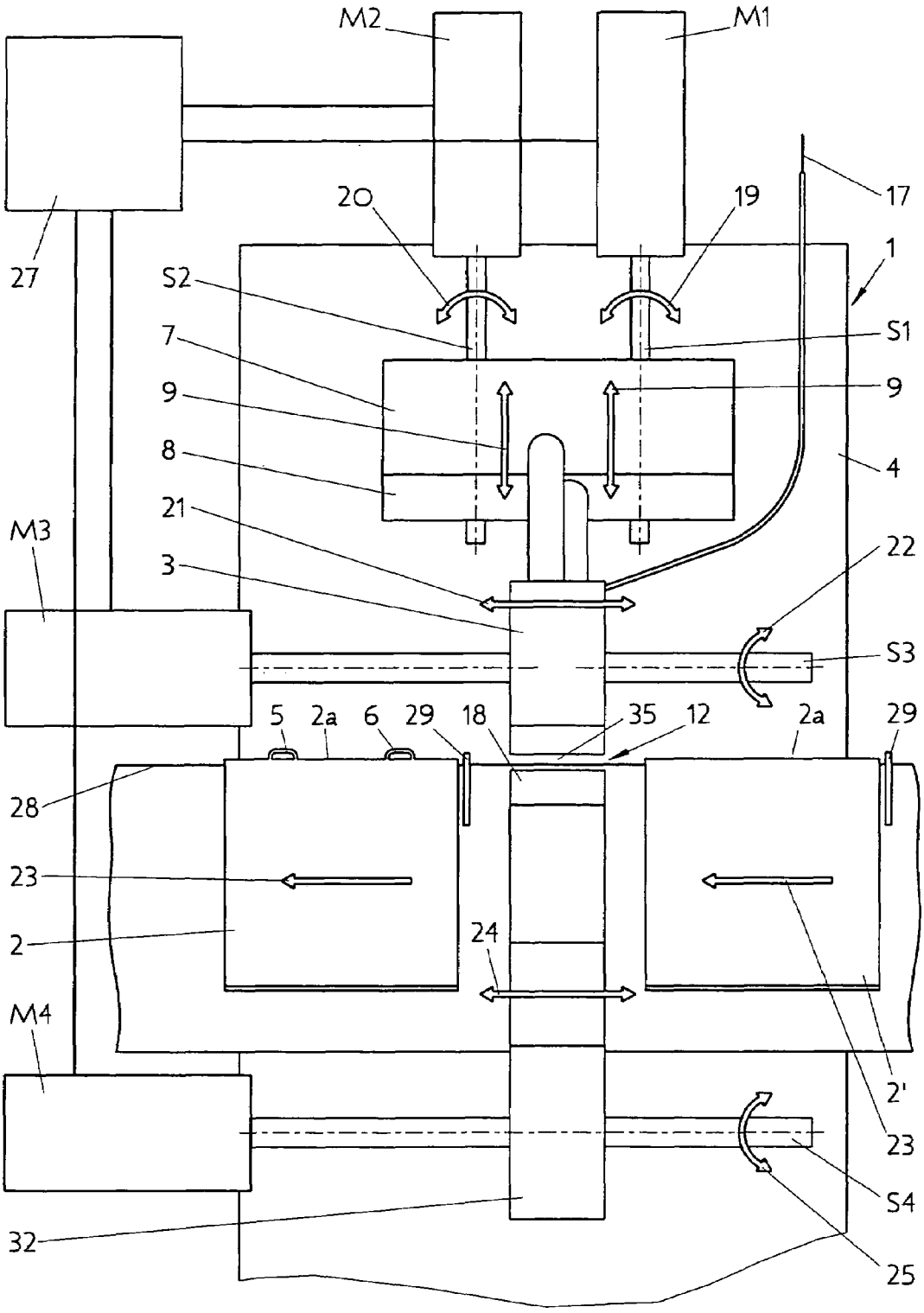
FIG. 1 Shows a schematic view of a wire-stitching machine according to the invention.

FIG. 1 shows a wire-stitching machine 1 according to the invention for stitching together print products 2, 2', for example by means of two wire staples 5 and 6. The wire-stitching machine 1 is arranged on a gathering and wire-stitching apparatus, of which only some sections of the gathering chain 28 are indicated in FIG. 1. The print products 2' to be stitched are conveyed on gathering chain 28 in the direction of arrows 23 and thus from right to left in FIG. 1. The print products 2' have a fold 2*a* on the top and are positioned straddling on the gathering chain 28. They are carried along by respective carriers 29, wherein the carriers 29 are arranged uniformly spaced on the gathering chain 28. A different and suitable conveying device can conceivably be used in place of the gathering chain 28. The staples 5 and 6 are preferably wire staples which can be shaped differently, for example also in the shape of a loop. FIG. 1 shows a print product 2 stitched together with two staples 5 and 6. In principle, it is also possible to use only one staple or more than two staples for the stitching operation. The wire staples 5 and 6 are placed along the fold 2*a*, wherein the staple positions can vary.

The wire-stitching machine 1 comprises a machine frame 4 with thereon positioned bending device 12, which is provided with a stitching head 3 and a so-called bending means 18. The stitching head 3 is arranged above the gathering chain 28 and the bending means 18 is arranged below it. A gap 35 exists between these two components through which the print products 2, 2', etc. can be transported and can be stitched in the process. A wire 17 that is pulled from a roll, not shown herein, is fed to the stitching head 3 in a manner known per se. A corresponding section is cut off wire 17 and is bent into the shape of a U by means of a forming means 11. With a driver 10, this U-shaped section is driven into the print product 2, 2', etc., to be stitched. The bending means 18 is provided with flaps, not shown herein, for this operation which operate jointly with the stitching head 3 to close the staple. No further explanations are needed since a person skilled in the art is well acquainted with these types of operations and suitable means for realizing them.

The stitching head 3 is mounted on a stitching head carriage 14 which in turn is positioned on a bearing plate 30, such that it can be displaced horizontally. The bearing plate 30 is provided with suitable guides, not shown herein, and is attached to the machine frame 4. A spindle S3, in particular a horizontally-positioned spindle, is used for the horizontal movement of the stitching-head carriage 14 in the directions of double arrow 21 and can be turned optionally in one or the other direction of double arrow 22 by means of a controlled motor M3. The spindle S3 is preferably connected to the stitching-head carriage 14 by means of a ball screw, not shown in further detail herein, which permits a precise movement of the stitching-head carriage 14, mostly without play. In principle, such a linear movement of the stitching-head carriage 14 can also be achieved with other suitable drive means. The motor M3 is controlled by a control device 27 and is preferably a rotational-angle controlled motor and/or a servomotor. The stitching-head carriage 14 is thus driven directly and without gears. By changing the rotational direction of the motor M3, the movement direction of the stitching head carriage 14 and thus also the stitching head 3 can be changed accordingly.

The driver 10 and the forming means 11 are moved in the vertical direction, in accordance with double arrows 9, for bending and driving in the wire staples 5 and/or 6, wherein a driver plate 7 is provided for the driver 10 and a plate 8 for the forming means. These two plates 7 and 8 are positioned vertically displaceable on a bearing plate 13 that is attached to the machine frame 4. The bearing plate 13 for this embodiment is provided with suitable guide rails 36 shown in FIG. 3.

Figure 3:
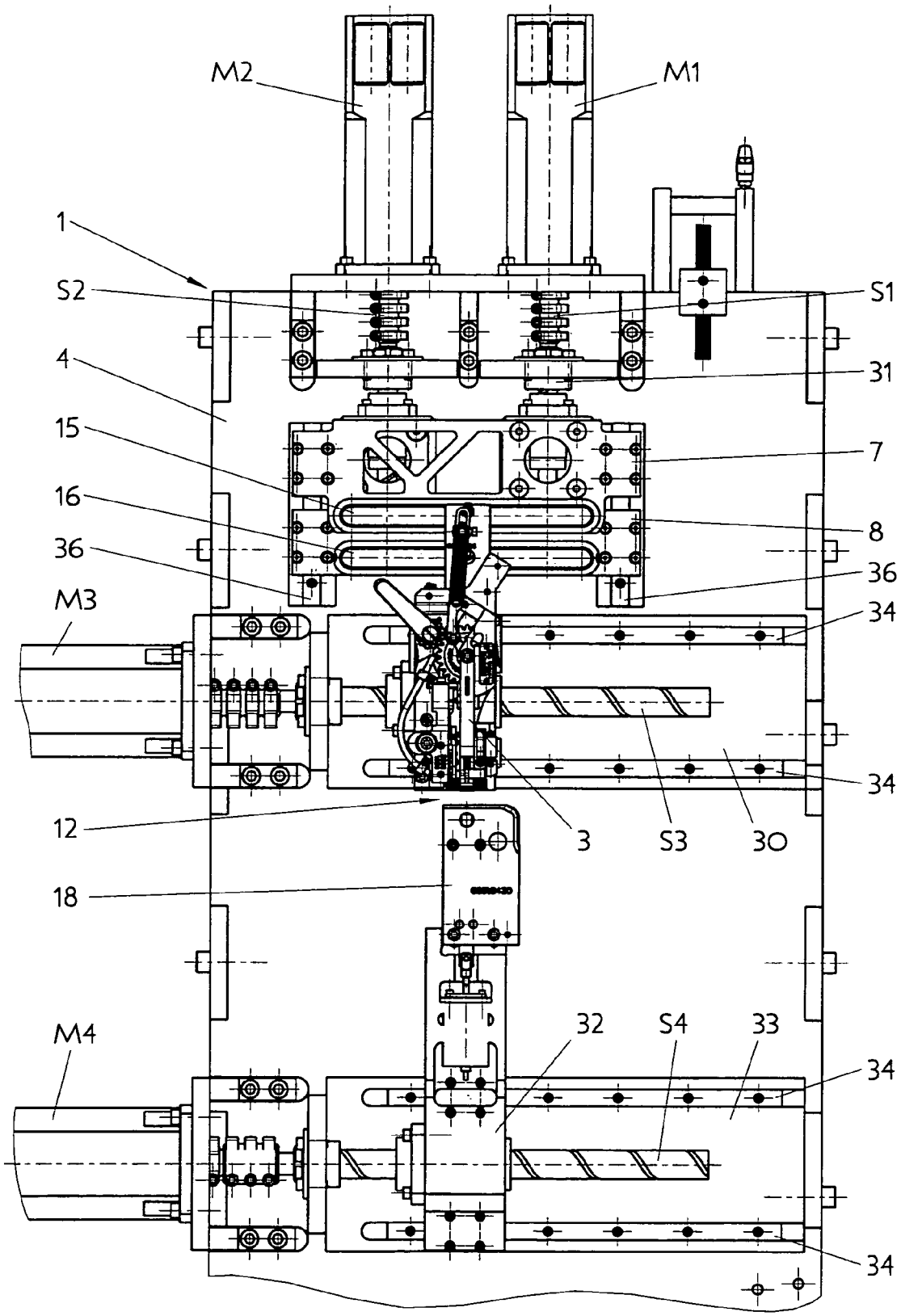
FIG. 3 Shows a more detailed view of the embodiment shown in FIG. 1.
Figure 4:
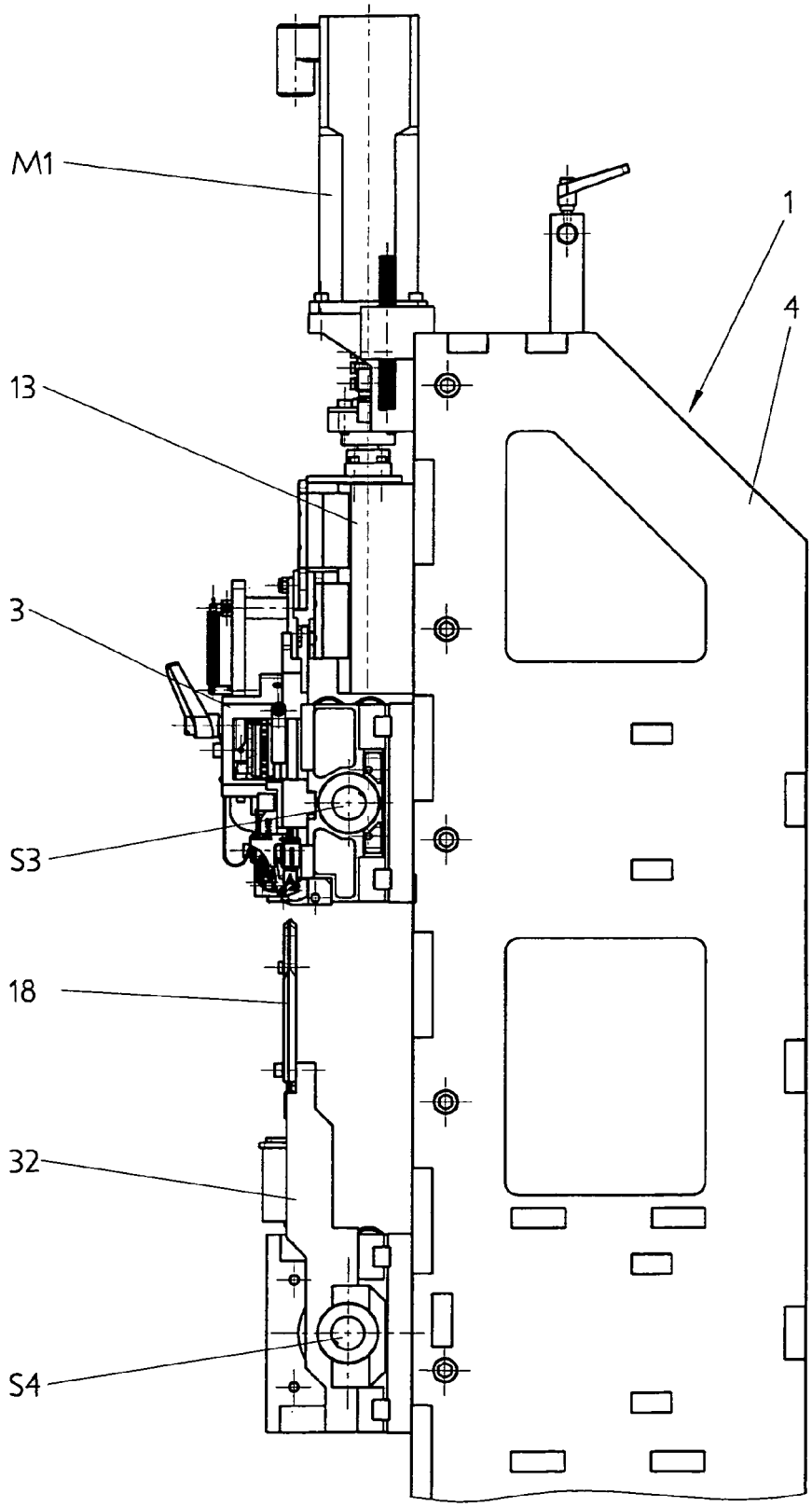
FIG. 4 Shows a more detailed view of the embodiment shown in FIG. 2.

FIG. 3 shows that the driver plate 7 and the forming means plate 8 are respectively provided with a horizontally extending guide slot 15 or 16. The driver 10 and the forming means 11 each comprise a roller or a slide ring, not shown herein, which engages and/or which engage in the guide slot 15 and/or 16. The guide slots 15 and 16 permit a correspondingly limited horizontal displacement of the driver 10 and the forming means 11.

The driver plate 7 is moved vertically up and down by means of a controlled motor M1, wherein a spindle S1, in particular a vertical spindle, is used in this case as well for the engagement. This spindle is connected via a spindle bearing 31 to the driver plate 7, substantially without play. The motor M1 is also preferably a rotational-angle controlled motor and/or a servomotor, wherein a different linear drive is conceivable as well.

A different motor M2 is provided for operating the forming means plate 8, which can have the same design as the motor M1 and which moves this plate 8 with the aid of a spindle S2. The motors M1 and M2 are also controlled by the control device 27. The rotational directions of spindles S1 and S2 are indicated in FIG. 1 with double arrows 19 and/or 20.

Since the thickness of the print products 2, 2' to be stitched can vary, the bending device 12 must be adapted to the different thicknesses. The stitching head 3 is therefore mounted on the stitching-head carriage 14, such that it can be adjusted in height manually or by means of a motor (selective binding), as schematically shown by arrow 40 in FIG. 2. For the changeover to a thicker product, the stitching head 3 is correspondingly moved upward relative to the stitching-head carriage 14, and for the changeover to a thinner product, the stitching head 3 is moved downward relative to the stitching-head carriage 14. This adaptation is comparably simple and is made possible by the aforementioned linear drives. Until now, the height of the forming means and the gathering chain had to be adjusted for a thickness adaptation.

Figure 2:
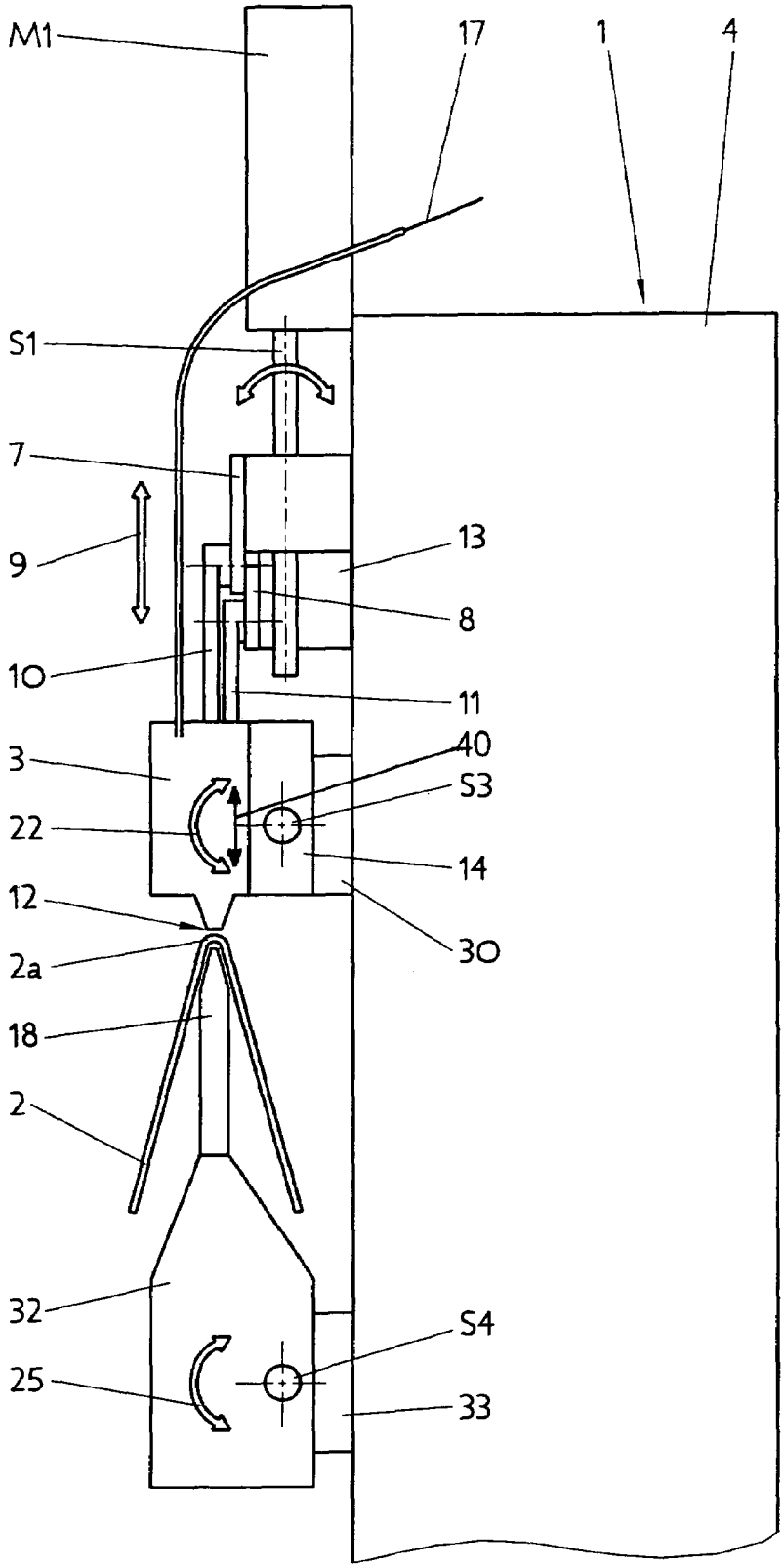
FIG. 2 Shows a different schematic view of the wire-stitching machine of FIG. 1.

During the stitching operation, the bending means 18 is located immediately below the fold 2*a* to be stitched and closes a staple 5 and/or 6 by bending the downward pointing legs, which are not shown in further detail herein. According to FIG. 3, the bending means 18 is mounted on a bending means carriage 32 which is positioned horizontally displaceable on a bearing plate 33. For this, the bearing plate according to FIG. 3 is provided with two guide rails 34, wherein such guide rails are also provided on the bearing plate 30 for the stitching-head carriage 14. The bending means carriage 32 is also driven by means of a controlled motor M4 and a spindle S4. FIG. 2 shows that the spindle S4 can be rotated by means of the motor M4 in the directions of double arrow 25, wherein the motor M4 is also connected to the control 27. By changing the rotational direction of motor M4, the bending means carriage 32 in FIG. 1 can be displaced with limitation to the left and to the right, in the directions of double arrow 24. The movements of the stitching head carriage 14 and bending means carriage 32 are coordinated. These movements occur synchronously so that the bending means 18 is always in the stitching position, relative to the stitching head 3, and the stitching head 3 and the bending means 18 cooperate to form a staple 5, 6.

The stitching head carriage 14 and the bending means carriage 32 for the bending means 18 are preferably operated independent of each other. Also conceivable is an embodiment provided with a single carriage with thereon positioned stitching head 3 and bending means 18. Accordingly, the stitching head 3 and the bending means 18 could then be operated by means of a single motor and a single spindle. The motors M1 to M4 and the spindles S1 to S4 can basically have identical designs. However, the motors M1 and M2 as well as the spindles S1 and S2 are preferably dimensioned smaller than the motors M3 and M4 and the spindles S3 and S4.

Figure 5:
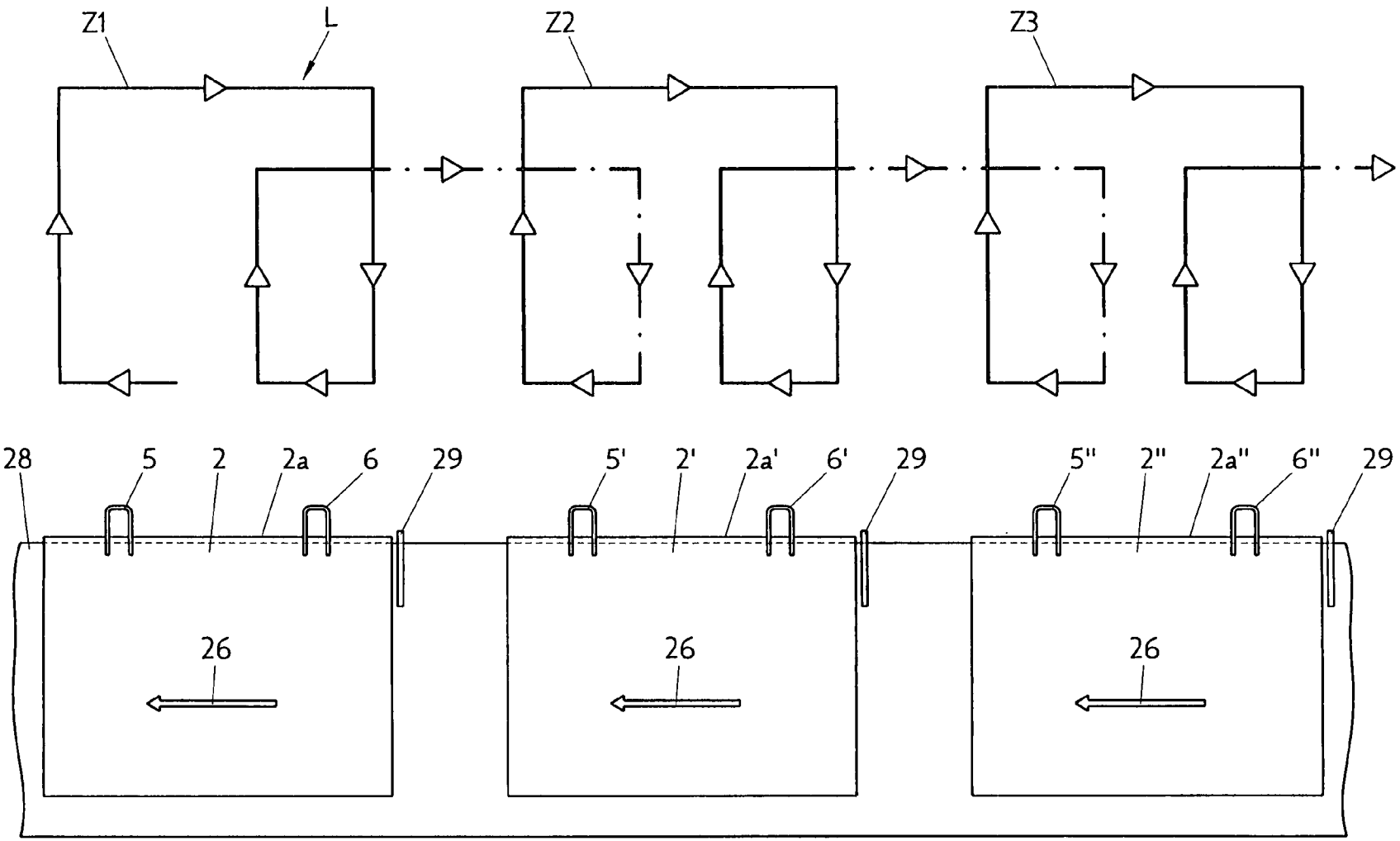
FIG. 5 Shows a schematic diagram of a possible sequence of the stitching cycles during the stitching of print products with respectively two wire staples, wherein the print products are conveyed on a gathering chain.

The wire-stitching method is explained in further detail in the following: FIG. 5 shows a schematic sequence of a stitching operation, wherein three print products 2, 2' and 2" are stitched together sequentially by means of respectively two staples 5, 6 and/or 5', 6' and/or 5", 6". The products are stitched along an upper fold 2*a*, 2*a'* and/or 2*a"*. In FIG. 5, the print products 2, 2' and 2" are conveyed by the gathering chain 28 from right to left, as shown with arrows 26. The spacing is determined by the carriers 29 which are attached to the gathering chain 28. Three cycles Z1, Z2, and Z3, shown schematically with a line L, are provided for the wire-stitching of print products 2, 2', and 2". The same stitching head 3 is used for the cycles Z1, Z2, and Z3. In FIG. 5, the cycles Z1, Z2, and Z3 are arranged side-by-side for drawing reasons.

In cycle Z1, the two staples 5 and 6 are driven in by means of the same stitching head 3, wherein only one staple and/or more than two staples can also be used in place of the two staples 5 and 6.

The following table contains examples of turning points along the paths followed by the driver 10 and the forming means 11 during the wire-stitching operation of a print product 2 with two staples 5, 6.

| Point | X coordinate | YB coordinate | YT coordinate | Comments |
|---|---|---|---|---|
| A | 0 | 28 | 38 | start |
| B | −9.6 | 9.7 | 22.7 | |
| C | −68.5 | 0 | 0 | 1st staple |
| D | −88 | 14.5 | 19.5 | |
| E | −68.5 | 28 | 38 | |
| F | −67.7 | 28 | 38 | |
| G | −46.9 | 28 | 38 | |
| H | −66.5 | 9.7 | 22.7 | |
| I | −115.3 | 0 | 0 | 2nd staple |
| K | −134.9 | 14.5 | 19.5 | |
| L | −115.3 | 28 | 38 | |
| A | 0 | 28 | 38 | end |

The above-mentioned turning points form supporting points and lead to closed paths which make possible the required movement guidance. The stitching head carriage 14 and the bending means carriage 32 are guided in horizontal direction (X), and the driver plate 7 as well as the forming means plate 8 (YB, YT) are guided in dependence on the time, as shown in the above table.

The cycle time, meaning the time required for traveling from point A to point L in the above table, can vary as a result of the drives that are provided. Short cycle times result in correspondingly fast movements and a higher product throughput capacity. During slow and fast cycles, the same points and positions are traveled to in the vertical direction. In the horizontal direction, the path curve is extended in accordance with the higher speeds, which represents one difference to the present curve control where the driver and forming means always travel the same spatial curve, even if the speeds are different.

As previously mentioned, the same stitching head 3 and the same bending means 18 are used for placing the two staples 5 and 6 during one stitching cycle. The two staples 5 and 6 are thus driven with the same stitching head 3 into the print product 2. The sequence can be called a "pilgrim step," since the movement of the stitching head 3 between the placement of the first staple 5 and the second staple 6 runs counter to the movement of the print product 2. A movement in the direction opposite to the conveying direction therefore occurs periodically. During the stitching operation, the stitching head 3 must move synchronously with the print product 2, thereby resulting in a sequence with back and forth movements. A cycle comprises a first step where the stitching head 3 is accelerated to the conveying speed of the print product 2. Once the stitching head 3 has reached the respective speed, the first staple 5 is driven in. In a third step, the speed is slowed until it reaches 0. In a fourth step, the stitching head 3 is again accelerated until it has reached the speed of the print product 2 and the second staple 6 is then driven in and the legs are bent. The print product 2 then leaves the wire-stitching machine 1 and is supplied, for example, to a trimmer (cutting machine) that is not shown herein. The print products 2' and 2" are stitched one after another during the same sequences. The bending means 18 in this case is moved synchronously with the stitching head 3.

For the embodiment according to the above table, the X coordinate for driving in the wire staple is −9.6 mm. At the start of the cycle, the stitching head carriage 14 is accelerated in the same direction as the print product 2. At the same time, the driver plate 7 and the forming means plate 8 are accelerated vertically in downward direction. At position C, the two plates 7 and 8 have reached their lowest position and are stopped, meaning their speed is 0, and the first staple 5 is driven in. Following the placement of the first staple 5, the stitching head carriage 14 still moves in conveying direction of the gathering chain 28. The speed is then slowed until point D while, at the same time, the driver plate 7 and the forming means plate 8 are accelerated in upward direction and reach their maximum speed at point D. Following this, they are slowed until they reach a speed of 0 at point E. The stitching head carriage 14 at the same time changes its speed and is accelerated counter to the conveying direction for the gathering chain 28. From point E to point G, only the stitching head carriage 14 moves and is subsequently stopped at point G. From that point onward, the stitching head carriage 14 and the driver plate 7 as well as the forming means plate 8 are again accelerated and the above-described operation repeats itself after point A. The staple 6 is driven in during this operation. The stitching-head carriage 14 then moves back to a starting position, to point A on the right lift end. As soon as the following print product 2' has again reached the respective position, the cycle is repeated. The same cycle or sequence is repeated for the print product 2".

The previously mentioned "pilgrim step" represents only a preferred example. Also conceivable is a method where the stitching-head carriage 14 does not change direction, following the placement of the first staple 5, but continues to move in conveying direction and eventually drives in the second staple 6. The movement is reversed only then for the return, which is correspondingly longer than for the above-described method. However, it has turned out that a staple can be driven in faster and a higher output is possible with the aforementioned "pilgrim step" method.

The spacing between the staples 5 and 6, as well as their locations on the print product 2, can be changed continuously by entering corresponding changes at the control unit for motors M1 to M4. Such changes are easily made through a corresponding input of data and do not require that the machine is stopped or not for a longer period of time.

The exemplary embodiment shown herein is provided with single stitching head 3 that is arranged on the stitching-head carriage 14. In principle, an embodiment with more than one stitching head 3 on the stitching-head carriage 14 is conceivable as well. Also conceivable is an embodiment comprising several stitching-head carriages 14. With two stitching-head carriages 14, these can move in opposing directions in a manner known per se, using the so-called boxer principle. Finally, it is also conceivable to replace the above-mentioned stitching head 3 with a different stitching device, using a different method for shaping and driving in the wire.

The wire-stitching machine 1 can also be used for a pre-stitching operation. In that case, the print products are pre-stitched with a wire staple in a first step and, following the depositing of additional print products, can be wire-stitched together with these additional products during a second step.

It will be understood that the above description of the present invention is susceptible to various modifications, changes and adaptations, and the same are intended to be comprehended within the meaning and range of equivalents of the appended claims.

What is claimed is:

1. A method for wire-stitching print products with a wire-stitching machine, comprising:

conveying a print product in a conveying direction on a gathering and wire-stitching apparatus;

moving a stitching head in a direction parallel to the conveying direction of the print product;

driving a first wire staple in the print product with the stitching head; and following the driving of the first wire staple, displacing the stitching head in the parallel direction relative to the print product and driving a second wire staple into the print product.

2. The method according to claim 1, wherein the stitching head comprises a staple driver and a staple forming device, and the method further includes operating the staple driver and the staple forming device by respective controlled motors.

3. The method according to claim 2, wherein the staple driver and the staple forming device are driven in a linear direction.

4. The method according to claim 2, wherein the operating step includes controlling a driving speed for driving in a staple independent of a cycle time for a stitching operation.

5. The method according to claim 4, wherein the controlling step includes controlling the driving speed for driving in a wire staple to be constant.

6. The method according to claim 1, including arranging the stitching head in a stitching-head carriage and driving the stitching head carriage by a controlled motor parallel to the conveying direction of the print products.

7. The method according to claim 6, including driving the stitching-head carriage in a linear direction.

8. The method according to claim 1, including arranging a staple bending device with a staple bending device carriage below the stitching head and driving the staple bending device carriage by a controlled motor to be displaceable in a linear direction, parallel to the conveying direction.

9. The method according to claim 1, including performing a stitching cycle for stitching a print product with the stitching head that includes moving the stitching head counter to the conveying direction of print products for placement of a second staple following the placement of a first staple.

10. The method according to claim 1, including moving the stitching head in the conveying direction of the print product for driving in the first and second staples and subsequently moving the stitching head back in a direction opposite to the conveying direction of print products.

11. The method according to claim 1, including vertically displacing the stitching head for a changeover to a print product with a different thickness.

12. The method according to claim 1, wherein the stitching head comprises a staple driver and a staple forming device, and the method further includes:

driving the staple driver and the staple forming device by respective controlled motor in a linear direction;

arranging the stitching head in a stitching-head carriage and driving the stitching head carriage by a controlled motor parallel to the conveying direction of the print products;

arranging a staple bending device with a staple bending device carriage below the stitching head and driving the staple bending carriage by a controlled motor to be displaceable in a linear direction, parallel to the conveying direction; and driving the staple forming device, the driver, the stitching-head carriage and the staple bending device carriage independent of each other.

13. The method according to claim 1, including placing the first staple in the front and the second staple at a distance to the first staple in the back of the print product, as seen in conveying direction of the print products.

14. The method according to claims 1, including placing the first staple at the back and the second staple at a distance to the first staple toward the front of the print product, as seen in conveying direction.

15. The method according to claim 1, including:

arranging the stitching head in a stitching-head carriage;

arranging a staple bending device with a staple bending device carriage below the stitching head; and jointly operating the stitching-head carriage and the staple bending device carriage by a single motor to drive the stitching head carriage and the staple bending device carriage in a linear direction parallel to the conveying direction.

16. A wire-stitching machine for a gathering and wire-stitching apparatus in which print products move in a conveying direction, comprising:

at least one stitching head operative to stitch a respective print product during a stitching operation;

a stitching head carriage mounting the stitching head and arranged to move in a back and forth direction parallel to the conveying direction;

a controlled motor coupled to the stitching head carriage to directly drive the stitching head carriage in the back and forth direction; and a control device coupled to control the controlled motor and the stitching head so that the stitching head is displaced relative to the print product following a placement of a first staple by the stitching head in a print product to drive in at least one second staple at a distance to the first staple.

17. The wire-stitching machine according to claim 16, wherein the machine comprises a single stitching head.

18. The wire-stitching machine according to claim 16, wherein the at least one stitching head comprises a staple driver and a staple forming device; and further including first and second controlled motors to respectively drive the staple driver and the staple forming device in a direction perpendicular to the conveying direction for print products.

19. The wire-stitching machine according to claim 18, and further including first and second spindles coupled respectively to the first and second motors and operatively arranged with the staple driver and the staple forming device to directly drive, respectively, the staple driver and the staple forming device in a linear direction.

20. The wire-stitching machine according to claim 18, further including a staple bending device carriage; a staple bending device arranged on the staple bending device carriage below the stitching head; and a controlled motor arranged to directly drive the staple bending device carriage; wherein the control device separately controls the respective motors.

21. The wire-stitching machine according to claim 20, further including spindles, each said spindle coupled to a respective one of staple driver, staple forming device, stitching head carriage and staple bending device carriage, and each controlled motor drives a respective one of the spindles.

22. The wire-stitching machine according to claim 16, further including a driver plate and a forming device plate by which the staple driver and the staple forming device are respectively driven, and wherein the driver plate and the forming device plate respectively include a guide slot to provide for a horizontal movement of the staple driver and the staple forming device.

23. The wire-stitching machine according to claim 16, further including a stitching head carriage on which the stitching head is arranged; and a controlled motor arranged to directly drive the stitching head carriage.

24. The wire-stitching machine according to claim 16, further including a staple bending device carriage; a staple bending device arranged on the staple bending device carriage below the stitching head; and first and second spindles, wherein the stitching-head carriage and the staple bending device carriage are driven horizontally by the first and second spindles, respectively.

25. The wire-stitching machine according to claim 24, further including a single controlled motor to jointly drive the stitching head carriage and the staple bending device carriage.

* * * * *